US006966127B2

(12) United States Patent
Petzl et al.

(10) Patent No.: US 6,966,127 B2
(45) Date of Patent: Nov. 22, 2005

(54) ICE SPIKE FOR MOUNTAINEERING

(75) Inventors: Paul Petzl, Barraux (FR); Laurent Perrod, Crolles (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/787,202

(22) Filed: Feb. 27, 2004

(65) Prior Publication Data

US 2004/0194346 A1 Oct. 7, 2004

(30) Foreign Application Priority Data

Apr. 4, 2003 (FR) ..... 03 04225

(51) Int. Cl.[7] ..... A43B 3/16
(52) U.S. Cl. ..... 36/7.6
(58) Field of Search ..... 36/7.5, 7.6

(56) References Cited

U.S. PATENT DOCUMENTS 2,102,500 A * 12/1937 Walthers ..... 36/7.6
3,685,173 A * 8/1972 Piazza ..... 36/7.6
4,353,172 A * 10/1982 Bryant ..... 36/7.6
4,480,396 A * 11/1984 Lowe et al. ..... 36/7.6
2003/0037461 A1 * 2/2003 Petzl et al. ..... 36/7.6

FOREIGN PATENT DOCUMENTS

| | | |
|---|---|---|
| EP | 1 254 611 A1 | 11/2002 |
| FR | 2 575 659 | 7/1986 |
| FR | 2 722 067 | 1/1996 |
| FR | 2 763 858 | 12/1998 |
| FR | 2 828 794 | 2/2003 |

* cited by examiner

*Primary Examiner*—Ted Kavanaugh
(74) *Attorney, Agent, or Firm*—Oliff & Berridge, PLC

(57) ABSTRACT

An ice spike comprises a fixing clamp attached to the fixed rear part of the armature and having a cross-bar designed to latch directly onto a rear rim of the sole. The front part of the armature comprises stop means to wedge the front of the shoe in the longitudinal direction. A strapping system is provided with at least one safety lanyard arranged to press the shoe against the bearing surface. After lengthwise adjustment of the strip has been performed according to the shoe size, fitting the shoe does not require any variation of distance between the rear fixing clamp and the front stop means.

4 Claims, 4 Drawing Sheets

ICE SPIKE FOR MOUNTAINEERING

BACKGROUND OF THE INVENTION

The invention relates to an ice spike for mountaineering having a metal armature designed to be fitted under the sole of a shoe, said armature comprising:

- a bearing surface having a plurality of anchoring teeth along the periphery,
- a front part equipped with means for securing the front of the shoe,
- a rear part provided with a fixing clamp comprising a cross-bar designed to latch directly onto a rear rim of the sole to secure the heel of the shoe,
- means for adjusting the armature in length according to the shoe size,
- and a strapping system associated to tightening means to secure the armature to the sole of the shoe.

STATE OF THE ART

The document FR-A 2,828,794 describes an ice spike for mountaineering the rear fixing part of the armature whereof comprises a pivoting clamp equipped with a lateral operating lever enabling the rear rim of the heel of the sole to be clamped to the maximum. The operating lever comprises a spindle inserted into a hole of the armature. One of the ends of the clamp passes through a rotating sleeve supported by an extension of the lever so as to constitute a toggle-joint causing blocking or releasing depending on the direction of pivoting of the lever. Actuation of the operating lever to the blocking position causes a forward translation movement of the clamp. Operating the lever in the opposite direction to the released state results in an opposite translation movement of the clamp to the rear so as to release the rim of the sole.

The documents FR 2,722,067 and CH 656,052 relate to an ice spike the rear part of the armature whereof comprises a pivoting fixing clamp which is equipped with a heel-part in the form of a latch articulated on the body of the clamp. The nose of the heel-part presses on the rear rim of the sole when an attachment strap is tightened.

The document DE 2,264,044 concerns an ice spike comprising a joining cable between the front part and the rear part and a fixing lever pressing on the rear rim of the sole. Pivoting of the lever in the direction of the rear of the shoe causes tensioning of the joining cable.

The document WO 98/36654 describes an ice spike comprising, in the central part, a mechanical link with an eccentric causing a relative movement between the front part and the rear part of the armature. The shoe is wedged at the front by a hoop and at the rear by a fixed clamp.

The document FR 914,269 relates to a rear fixing device of an ice spike comprising two mobile branches articulated and joined to one another by a tensor with an eccentric.

The document FR 2,575,659 concerns a quick-fix ice spike, the front part and the rear part whereof are joined by an attachment system composed of two cables tensioned by an intermediate tightening loop.

All the known ice spikes have attachment systems making the distance between the front and rear securing means vary for fitting the shoe.

OBJECT OF THE INVENTION

The object of the invention is to achieve an ice spike that is able to be fixed and removed quickly under a sole regardless of the type of shoe with a rear sole rim.

According to the invention, the front part of the armature comprises stop means to wedge the front of the shoe in the longitudinal direction, and the strapping system comprises at least one safety lanyard fixed to the fixing clamp of the rear part pressing the cross-bar onto said rim when clamping is performed.

After lengthwise adjustment of the armature has been performed according to the shoe size, placing the shoe on the bearing surface does not require any variation of the distance between the rear fixing clamp and the front stop means of the spike.

According to a preferred embodiment, the fixing clamp is achieved by means of a steel wire folded into a U shape, that is mounted with pivoting in a pair of transversely aligned holes in the rear part under the plane of the bearing surface of the armature.

Other features can be used alone or in combination:

- the cross-bar of the fixing clamp is joined to the lateral branches by two loops for passage of the lanyard;
- each lateral branch of the fixing clamp is inclined with respect to the cross-bar making an obtuse angle;
- the stop means comprise a hoop pivotally mounted around a horizontal axis extending at the front of the armature;
- the stop means comprise two protuberances salient at the front of the bearing surface.

BRIEF DESCRIPTION OF THE DRAWINGS

Other advantages and features will become more clearly apparent from the following description of a particular embodiment of the invention given as a non-restrictive example only and represented in the accompanying drawings, in which.

DESCRIPTION OF A PREFERRED EMBODIMENT

Figure 1:
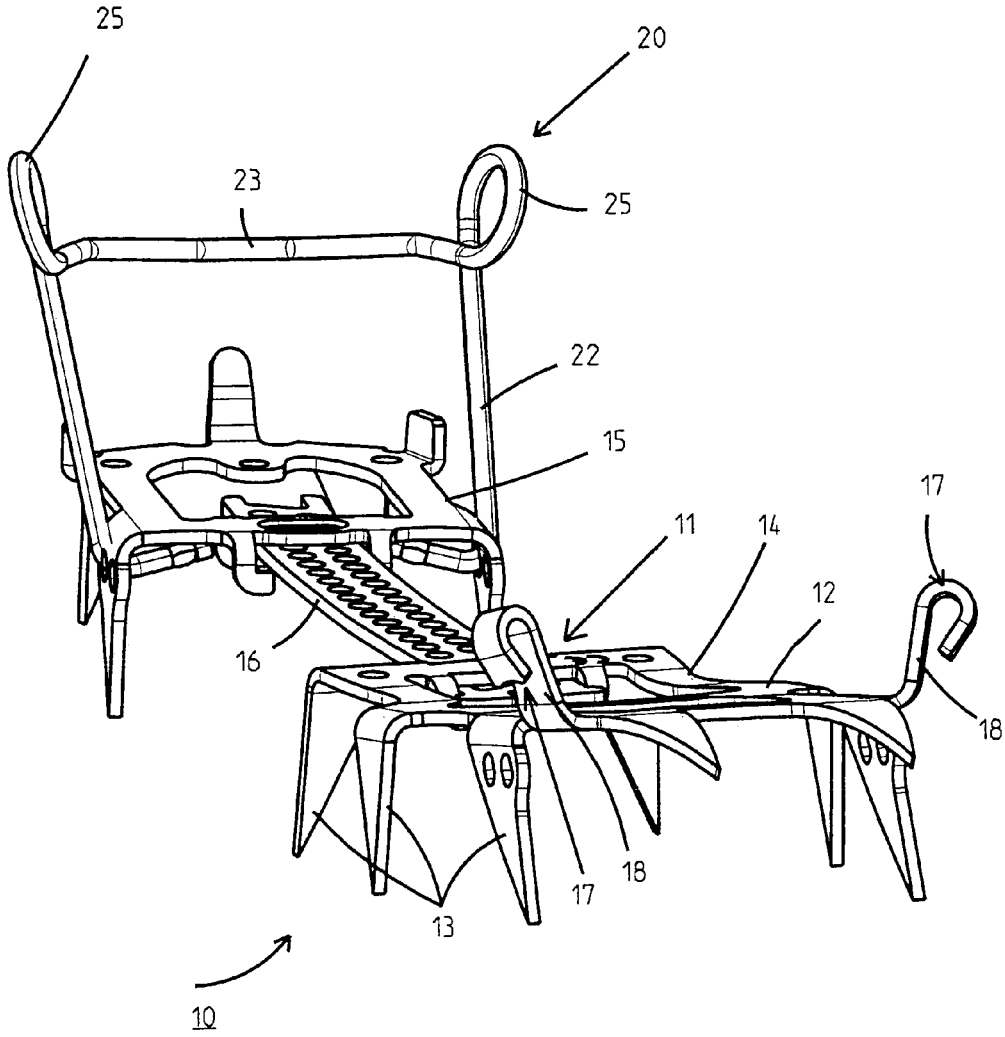
FIG. 1 is a perspective view of the ice spike according to the invention.
Figure 2:
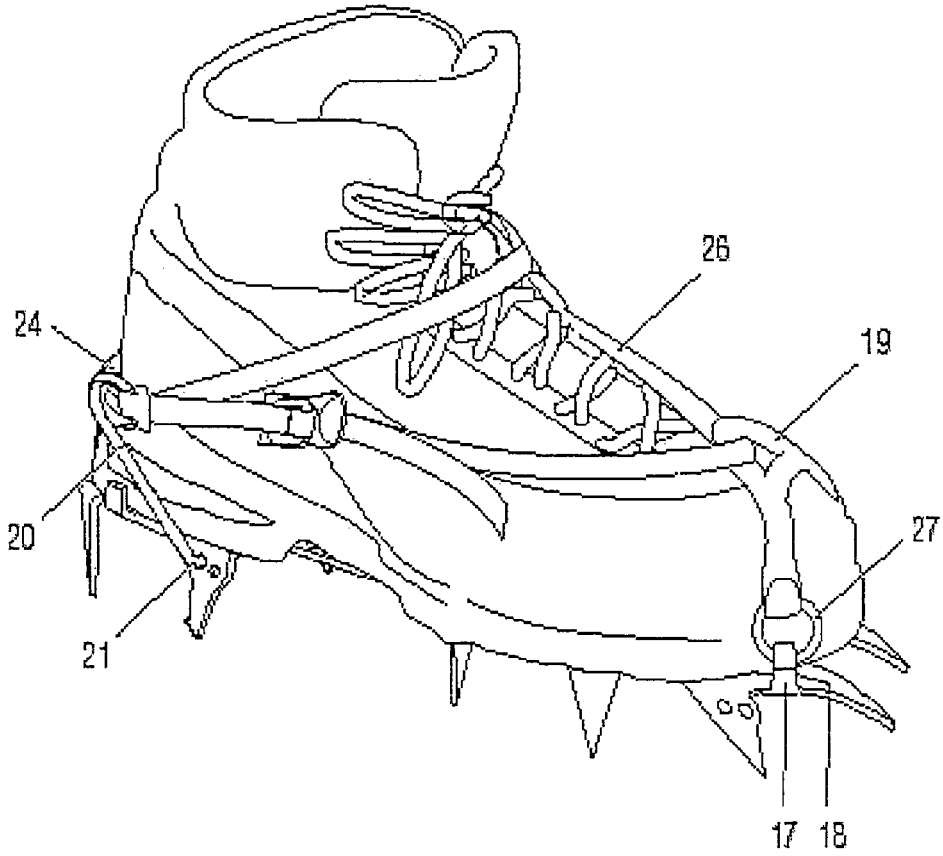
FIG. 2 shows the spike of FIG. 1 attached to the sole of a climbing shoe.
Figure 3:
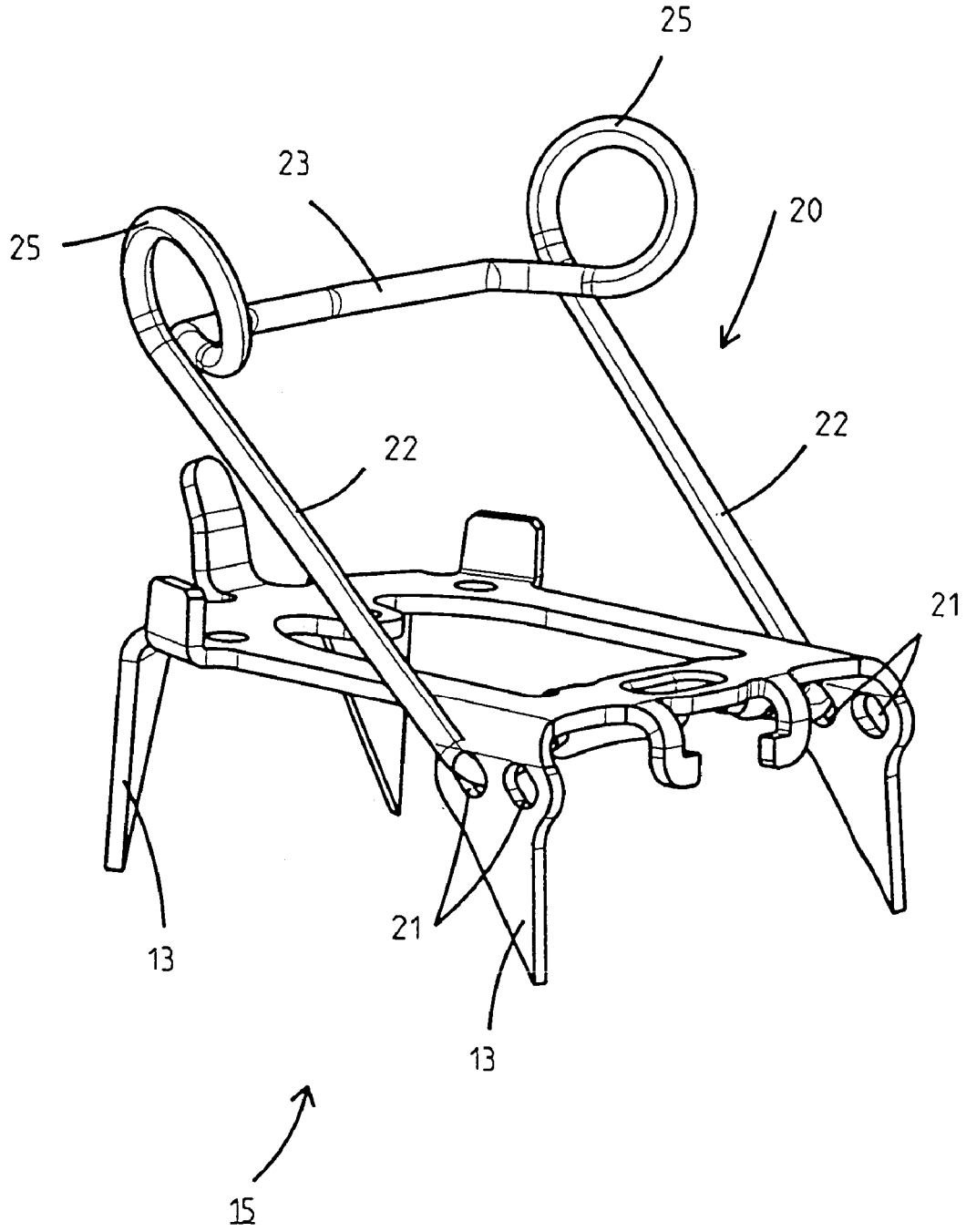
FIG. 3 shows a perspective view of the rear part of the spike of FIG. 1.
Figure 4:
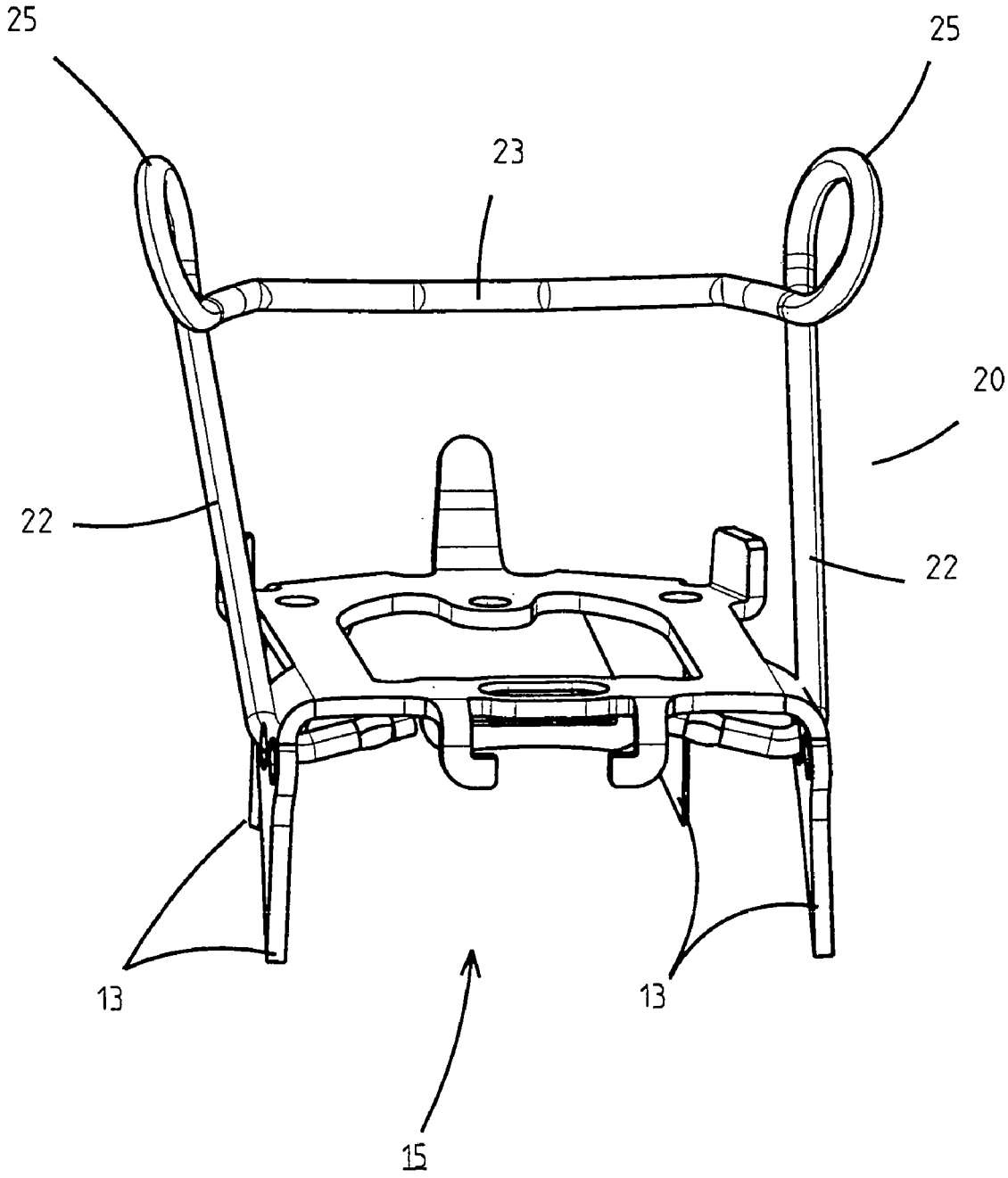
FIG. 4 represents a rear view of FIG. 2.

In the figures, an ice spike 10 for mountaineering comprises a metal armature 11 having a horizontal bearing surface 12 designed to receive the sole of a climbing shoe, and a plurality of anchoring teeth 13 staggered vertically along the periphery.

The armature 11 is composed of a front part 14 mechanically joined to a rear part 15 by a connecting strip 16 that is adjustable in length according to the shoe size. The connecting strip 16 can be replaced by any other assembly or adjustment means enabling a relative translation movement to be obtained between the front part 14 and the rear part 15.

The front part 14 of the armature 11 comprises stop means 17 to wedge the front of the shoe in the longitudinal direction. The stop means 17 can be formed for example by protuberances 18 protruding upwards at the front of the bearing surface 12 and arranged as ring-holders to pass attachment straps 19 through. It is also possible to replace the protuberances 18 by a hoop mounted swivelling around a horizontal axis extending at the front of the armature 11.

The rear part 15 of the armature 11 is equipped with a fixing clamp 20 to secure the heel of the shoe. The ends of the lateral branches 22 of the fixing clamp 20 are articulated in holes 21 aligned transversely in the rear part 15 under the plane of the bearing surface 12. The cross-bar 23 between the branches 22 hooks directly onto the rear rim 24 of the sole without it being necessary to make use of a heel-part or an additional catch for securing the heel. The cross-bar 23 presents a curved shape which substantially follows the outline of the heel of the shoe at the level of the rim of the sole.

The fixing clamp 20 is achieved by means of a steel wire that is folded into a U shape so that each lateral branch 22 is joined to the cross-bar 23 by a loop 25. The incline of the lateral branches 22 with respect to the cross-bar 23 is made with an obtuse angle.

A strapping system comprises at least one safety lanyard 26 passing through the loops 25 of the fixing clamp 20 and associated with tightening means to press the cross-bar 23 onto the rim 24 of the sole. The safety lanyard 26 can be long passing via the front attachment ring 27, or short surrounding only the upper of the shoe at the level of the instep. The choice of the type of lanyard 26 depends on the securing means used at the front of the spike 10.

After the length of the armature 11 has been adjusted according to the shoe size, placing the shoe on the bearing surface 12 does not require any variation of the distance between the rear fixing clamp 20 and the front stop means 17 of the spike 10.

What is claimed is:

1. Ice spike for mountaineering, having a metal armature designed to be fitted under the sole of a shoe, said armature comprising:

a bearing surface having a plurality of anchoring teeth along the periphery, a front part equipped with stop means to wedge the front of the shoe in the longitudinal direction, a rear part provided with a fixing clamp comprising a cross-bar designed to latch directly onto a rear rim of the sole to secure the heel of the shoe, a longitudinal connecting strip between the front part and the rear part for adjusting the armature in length according to the shoe size, and a strapping system comprising at least one safety lanyard fixed to the fixing clamp of the rear part pressing the cross-bar onto said rim when clamping is performed, wherein the stop means comprises two protuberances salient at the front of the bearing surface, said protuberances being shaped as ring-holders for passage of a lanyard.

2. Ice spike according to claim 1, wherein the fixing clamp of the rear part is achieved by means of a steel wire folded into a U shape, that is mounted with pivoting in a pair of holes arranged transversely in the rear part of the armature under the plane of the bearing surface.

3. Ice spike according to claim 1, wherein the cross-bar of the fixing clamp is joined to the lateral branches by two loops for passage of the lanyard.

4. Ice spike according to claim 3, wherein each lateral branch of the fixing clamp is inclined with respect to the cross-bar making an obtuse angle.

* * * * *